US010875606B2

(12) United States Patent
Claughton et al.

(10) Patent No.: US 10,875,606 B2
(45) Date of Patent: Dec. 29, 2020

(54) POWERBOAT

(71) Applicant: BA Technologies Limited, Poole (GB)

(72) Inventors: Andrew Ronald Claughton, Southampton (GB); Simon Schofield, Portsmouth (GB)

(73) Assignee: BA Technologies Limited, Poole (GB)

( * ) Notice: Subject to any disclaimer, the term of this patent is extended or adjusted under 35 U.S.C. 154(b) by 0 days.

(21) Appl. No.: 16/486,022

(22) PCT Filed: Feb. 15, 2018

(86) PCT No.: PCT/GB2018/050405

§ 371 (c)(1),
(2) Date: Aug. 14, 2019

(87) PCT Pub. No.: WO2018/150183

PCT Pub. Date: Aug. 23, 2018

(65) Prior Publication Data

US 2020/0047849 A1 Feb. 13, 2020

(30) Foreign Application Priority Data

Feb. 17, 2017 (GB) ..... 1702625.3

(51) Int. Cl.
*B63B 1/28* (2006.01)
*B63B 1/30* (2006.01)

(52) U.S. Cl.
CPC ..... *B63B 1/286* (2013.01); *B63B 1/30* (2013.01)

(58) Field of Classification Search
CPC ..... B63B 1/286; B63B 1/30
See application file for complete search history.

(56) References Cited

U.S. PATENT DOCUMENTS 2,832,304 A * 4/1958 Elyosius ..... B63B 39/061 114/280
3,081,728 A * 3/1963 Wilterdink ..... B63B 1/30 114/282
3,343,513 A 9/1967 Bader
3,797,434 A * 3/1974 Matthews ..... B63B 1/285 114/280
4,606,291 A 8/1986 Hoppe
(Continued)

FOREIGN PATENT DOCUMENTS

CN 105905232 A 8/2016
EP 2894090 A1 7/2015
(Continued)

OTHER PUBLICATIONS

Adee, et al., "Hydrostatic Stability of Large Hydrofoil Craft", Naval Engineers Journal, vol. 90, No. 6, Dec. 1978, 37-48.

*Primary Examiner* — S. Joseph Morano
*Assistant Examiner* — Jovon E Hayes
(74) *Attorney, Agent, or Firm* — Vos-IP, LLC

(57) ABSTRACT

A powerboat comprising a hull, a plurality of dynamically adjustable hydrofoils positioned below the waterline towards the rear of the hull, and a control system, wherein the cross sectional area of the hull below the waterline decreases towards the rear of the hull, and the control system is configured to adjust the hydrofoils in operation of the powerboat to control the running trim of the powerboat. The powerboat can operate efficiently at over a wide range of Froude numbers, in particular both low (displacement mode) speeds and high (planing mode) speeds.

21 Claims, 10 Drawing Sheets

(56) References Cited

U.S. PATENT DOCUMENTS 4,615,291 A * 10/1986 Jones ..... B63B 1/242 114/280
4,915,048 A * 4/1990 Stanford ..... B63B 1/30 114/274
5,315,951 A * 5/1994 Finkl ..... B63B 1/285 114/280
5,329,870 A 7/1994 Cook
5,373,800 A 12/1994 Steinberg
5,860,384 A * 1/1999 Castillo ..... B63B 39/061 114/274
6,164,235 A * 12/2000 Hoppe ..... B63B 1/248 114/275
7,140,318 B1 11/2006 Gasper
7,644,672 B2 * 1/2010 Welbourn ..... B63B 41/00 114/39.24
2005/0126464 A1 * 6/2005 Lang ..... B63B 1/18 114/67 A
2005/0145156 A1 7/2005 Chesney et al.
2008/0216728 A1 * 9/2008 Hofbauer ..... B63B 41/00 114/39.25
2009/0283023 A1 * 11/2009 Welbourn ..... B63B 43/04 114/39.24
2014/0224166 A1 * 8/2014 Morvillo ..... B63B 39/061 114/285
2015/0274266 A1 10/2015 Eveleth
2020/0047849 A1 * 2/2020 Claughton ..... B63B 1/30

FOREIGN PATENT DOCUMENTS

EP 3504115 B1 7/2020
FR 3001702 A1 8/2014
WO WO/2004/020276 A1 3/2004
WO WO/2007/148966 A2 12/2007
WO WO/2015/162000 A1 10/2015
WO WO/2016/010423 A1 1/2016

* cited by examiner

Typical Hull Shapes

Displacement Hull Form

Pressures on a Displacement Hull Form

Planing Hull Form

Semi Planing Hull Forms

Fast Displacement Hull Form

Resistance Comparison

Lines Plan

Foil Installation

Foil Installation

Foil Installation

Foil Installation

Foil Installation

Conventional Shaftline

Outdrive / Outboard

Pod Drive

Typical Control System Components

Hydrofoil Mounting

Hydrofoil Mounting

Missing Hull Volume

Hull Volume Removed in this Area

Control System Schematic

POWERBOAT

CROSS-REFERENCE TO RELATED APPLICATIONS

This application is a 371 of PCT Application No. PCT/GB2018/050405 filed on Feb. 15, 2018, which claims the benefit of British Patent Application No. 1702625.3 filed on Feb. 17, 2017, the contents of which are incorporated herein by reference in their entirety.

FIELD OF INVENTION

The present invention relates to a powerboat, which is optimized to operate with minimum hydrodynamic resistance at a wide range of speeds.

BACKGROUND OF THE INVENTION

A wide range of hull shapes for powerboats are known, and the shape of the hull varies in accordance with the speed at which the powerboat is intended to operate. The speed of a boat is commonly characterized by the Speed/Length ratio or the Froude number, a nondimensional number which is defined as: $Fn=V\sqrt{gL}$, where V is the speed, g is the gravitational constant (9.81 $m/s^2$ if using SI units), and L is the waterline length. Traditionally conventional powerboat hull types fall into three categories for three different Froude number ranges, as shown in FIG. 1 of the accompanying drawings, and described in the table below.

TABLE 1

| Fn range | Speed range (knots) for 12 m boat | Hull Type | Description |
|---|---|---|---|
| 0-0.6 | 0-10 | Displacement | At these speeds, the hull operates principally in a "displacement" mode. That is, the weight of the boat is supported by hydrostatic buoyancy forces, and as the boat moves forward the water passes around and under the hull. |
| 0.5-1.0 | 9-20 | Semi-Displacement | The boat weight is supported partly by hydrostatic buoyancy and partly by hydrodynamic lift. Most of the water passing the hull flows underneath it, i.e. along the buttock lines. |
| 0.8-2.0 | 18-50 | Planing | The boat's weight is substantially supported by the hydrodynamic lift forces exerted on the hull surfaces by the water passing underneath the hull. |

These 3 different regimes of flow and weight support demand that the shape of the hull is designed in accordance with the speed range intended for the boat. There are no hard and fast boundaries between the characteristics of the three hull types and vessels designed for similar speed regimes can have quite a different appearance.

The shape of a boat's hull is most usually presented as a "Lines Plan." These lines are derived from the intersection of the hull surface with three orthogonal planes. A lines plan comprises three views: the Body plan showing sections (intersection with transverse planes), the Profile view showing buttock lines (intersection with longitudinal planes), and the Plan view showing waterlines (intersection with horizontal planes). Additionally, the distribution of immersed cross sectional area along the length of the hull, referred to as the "Curve of Areas," defines the distribution of the immersed volume along the hull's length. This area distribution must be adjusted to ensure that the center of buoyancy at level trim matches the center of gravity. Additionally, for displacement and semi-displacement hulls, the immersed hull shape must achieve specific criteria in terms of the longitudinal center of buoyancy (LCB) and prismatic coefficient ($C_p$) for fuel efficient operation. Whilst the area distribution is of less significance for planing hulls the nature of the curve of areas offers the clearest definition of the differences between the three hull types and demonstrates the difficulties of configuring a hull for fuel efficient operation over a wide range of speeds. Thus the differences in hull shape must be catalogued not only by their lines but also by reference to their curve of areas.

Displacement hulls, as shown in FIG. 2, typically have a hull cross section with round bilges and a hull form which reduces in draught and width from the midship section of the hull, through the aft sections, to the stern. In other words, the depth and/or volume of the hull immersed below the design waterline reduces towards the stern. Thus the wetted area of the hull is minimized, and the zone of separated flow at the transom is reduced, both of which in turn reduce the hydrodynamic resistance. The fair and rounded hull shape provides comfortable seakeeping in rough water. Such hull shapes are seen on many boats, including modern large displacement craft. Smaller leisure craft, as shown in FIG. 3A, and small fishing boats, as shown in FIG. 3B, adapt the above characteristics to have considerably different appearances, but they retain the fundamental features of sectional area distribution along the hull length.

Typical Curves of Areas for the different hull types are shown in FIG. 4. A displacement hull is shown by line (A). The fundamental characteristic is that the maximum section area lies just aft of midships (B) and the immersed section area falls smoothly to zero at the stern (C). Additionally the section area distribution can be manipulated to control the Longitudinal Centre of Buoyancy (LCB) and Prismatic Coefficient ($C_p$) to optimize the hull shape for particular speeds within the Froude number range 0-0.6.

However, hulls of this shape are not suitable for boats which operate at higher speed (i.e. for the semi-planing and planing regime). As a hull operating in displacement mode is accelerated, the bow of the hull lifts out of the water, and the stern is sucked down by the accelerated flow around the curved after buttock lines. This induces a bow up trim as schematically illustrated in FIG. 5 that results in high drag and this demands unfeasibly high engine power to make the transition to planing speed. Also, at higher speed, the highly curved hull form induces a lack of stability and controllability, which adversely affects steering control, comfort, and safety. Therefore, hulls which are designed for planing typically have a number of different features in the hull shape to improve their behavior both when fully planing and when transitioning to the planing regime. First, they will have a higher immersed volume towards and at the stern than a displacement hull. This can be achieved by a keel line (centerline buttock) that remains horizontal from the point of maximum keel line depth. In other words, the draught of the hull remains substantially constant from the midship section to the stern of the craft. The section area curves for semi-displacement (D) and planing hull (E) forms are also shown in FIG. 4. The additional hull volume towards the stern of the craft compared to a displacement hull is a function of the straightened buttock lines which are required to eliminate the suction pressure and to lift the stern as speed rises. Semi-planing hulls generally have a tight bilge radius, or a hard chine as shown in FIG. 6. Planing hulls as illustrated in FIG. 7 have hard chines, i.e. sharp longitudinally-extending corners between flat faces of the hull, and a "deep-V" cross section in the forward part of the hull rather than a round-bilge shape. The use of chines and a deep-V hull improve the stability of the hull at high speeds.

A powerboat has to be designed to be safely operable at its maximum speed, which may be planing at high speed. However, it may spend most of its life operating at lower, more comfortable, and fuel efficient cruising speeds. Hulls which are designed as above for planing operation have the disadvantage that they have significantly higher drag at low speed, because of the extra volume towards the stern. The resulting increased wetted area and immersed transom result in higher hydrodynamic drag. Thus the design constraints arising from a boat's maximum speed may adversely affect its ability to be fuel efficient when the helmsman chooses to operate away from its maximum speed.

Traditionally, a boat's cruising speed and top speed have been within a few knots of each other, hence the easy division of hull types into displacement, semi-displacement, and planing types. However, it is becoming more common for owners of high speed vessels to operate at low speed to minimize fuel consumption, and reduce harmful emissions and noise, whilst still running at high speed when desired. With this change of operational profile the resistance of the hull at low speeds becomes more critical.

WO/2011/126358 A1 discloses a design for a powerboat hull which is intended to operate efficiently over a range of Froude numbers of up to 1.0, that is to say in displacement and semi-displacement modes. As illustrated in FIG. 8 of its drawings, it adopts a round bilge hull form in combination with a bulbous bow, spray rail, and an interceptor or transom flap to adjust the running trim of the vessel. This has been used commercially in a so-called "Fast Displacement Hull Form" (FDHF). It is unsuitable for, and not intended for, hulls operating at higher Froude numbers, being primarily intended for increasing the cruising efficiency of large power superyachts operating in displacement mode.

The development of hull forms like the FDHF demonstrates that it would be advantageous to have a powerboat hull which can operate efficiently over a greater range of Froude numbers, in particular both low (displacement mode) speeds and high (planing mode) speeds.

SUMMARY OF THE INVENTION

According to the present invention, there is provided a powerboat comprising: a hull; a plurality of dynamically adjustable hydrofoils positioned below the waterline towards the rear of the hull; and a control system; wherein the cross sectional area of the hull below the waterline decreases towards the rear of the hull; and the control system is configured to adjust the hydrofoils in operation of the powerboat to control the running trim of the powerboat.

This powerboat configuration has the advantage that it has low drag at low speeds, as with a boat conventionally designed for use in a displacement mode, and can also operate at high speed efficiently and safely in a semi-planing or planing mode by using the submerged dynamically-adjustable hydrofoils to control the running trim of the boat. The resistance of the present invention and a conventional powerboat are compared in FIG. 9 and this shows the lower resistance benefits at low speeds, whilst maintaining comparable resistance figures at higher speeds.

Hydrofoils are lift-generating elements with a high lift to drag ratio, preferably of smoothly curved cross section, that are positioned sufficiently far below the design waterline of the vessel to remain submerged over the whole design speed range. This distinguishes them from conventional trim control elements such as transom flaps and interceptors which are designed and positioned to operate at the surface of the water—i.e. at the design waterline of the vessel—and with one surface ventilated—i.e. exposed to air.

Preferably the hydrofoils are retractable, e.g. into a recess in the hull, or movable to a position above the waterline, to reduce drag when the boat is operating at low speed and to protect them from damage or marine growth when the boat is stationary.

The hydrofoils may be fully movable to control the running trim of the boat or may comprise a fixed section with a trailing edge flap.

The powerboat may further comprise a fixed hydrofoil in addition to the dynamically-adjustable hydrofoils, and the fore and aft center line of the fixed hydrofoil may be substantially aligned with the center line of the powerboat.

The dynamically-adjustable hydrofoils are preferably symmetrically-positioned at 30% of the beam of the boat (i.e. each of two hydrofoils either side of the centerline of the hull spans a point 30% of the lateral distance from the centerline to the maximum width of the hull).

The hydrofoils may be positioned aft or forwards, or aft and forwards of the powerboat drive. This can depend on the type of drive unit used—e.g. conventional shaft drive propeller from an inboard engine, outdrive or outboard, or pod-drive.

Preferably the hydrofoils are configured to support between 0% and 50% of the weight of the powerboat at its top speed, more preferably between 10% and 40% of the weight of the powerboat at top speed, more preferably between 15% and 25% of the weight, and yet more preferably substantially 20% of the powerboat at top speed. Thus unlike a conventional hydrofoil craft, the powerboat does not "foil" completely on the hydrofoils, but they instead raise the stern to control the running trim of the boat, with the remainder of the weight supported by the hull.

Preferably the control system is configured to automatically adjust the hydrofoils to control the running trim of the powerboat, and it may be configured to adjust the hydrofoils to control roll and/or pitch motions of the boat and/or to automatically adjust the hydrofoils to reduce and/or minimize hydrodynamic drag on the hull. Such automatic control means that the safe and efficient running of the boat is less dependent on the skill of the helmsman, though manual control of the hydrofoils can additionally be provided.

Preferably the hull is shaped such that the immersed area of the transom at rest is less than 40% of the maximum hull cross sectional area, more preferably less than 30% of the maximum hull cross sectional area, more preferably less than 20% of the maximum hull cross sectional area, and yet more preferably less than 10% of the maximum hull cross sectional area. This reduces the drag of the hull when the boat is operating at lower speeds, in displacement mode. At such speeds the hydrofoils may not be deployed or may be deployed at zero lift to reduce drag.

Preferably the control system comprises a speed sensor and/or attitude sensor.

The hydrofoils may be positioned in the rear 30% of the length of the hull, more preferably in the rear 20% of the length of the hull, and most preferably in the rear 10% of the hull.

Preferably each hydrofoil is connected to the hull by a strut.

In a preferred embodiment all portions of the bow which are below the design waterline are in line with, or aft of, all portions of the bow which are above the design waterline. Thus there is no forwardly extending bulbous bow beneath the waterline. The stem of the powerboat may be substantially vertical. These features give the hull a satisfactory performance when planing, when the bow will be at or above water level and impacts with waves need to be absorbed and the spray deflected with minimum disturbance to the vessel and crew.

Preferably the longitudinal position of maximum width of the hull is at 70% or less, more preferably 50% to 70%, of the distance from bow to stern. In a preferred embodiment a transition from V-shaped hull underwater cross section at the bow to rounded underwater hull cross section occurs by 50%, more preferably 40%, yet more preferably 30% of the distance from bow to stern. Again these features combine good performance at planing speeds with efficient performance at nonplaning speeds.

BRIEF DESCRIPTION OF THE FIGURES

The present invention will now be described by way of example only with reference to the following drawings.

DETAILED DESCRIPTION OF THE INVENTION

A powerboat 1 according to the present invention will now be described with reference to FIGS. 10-18.

Figure 10:
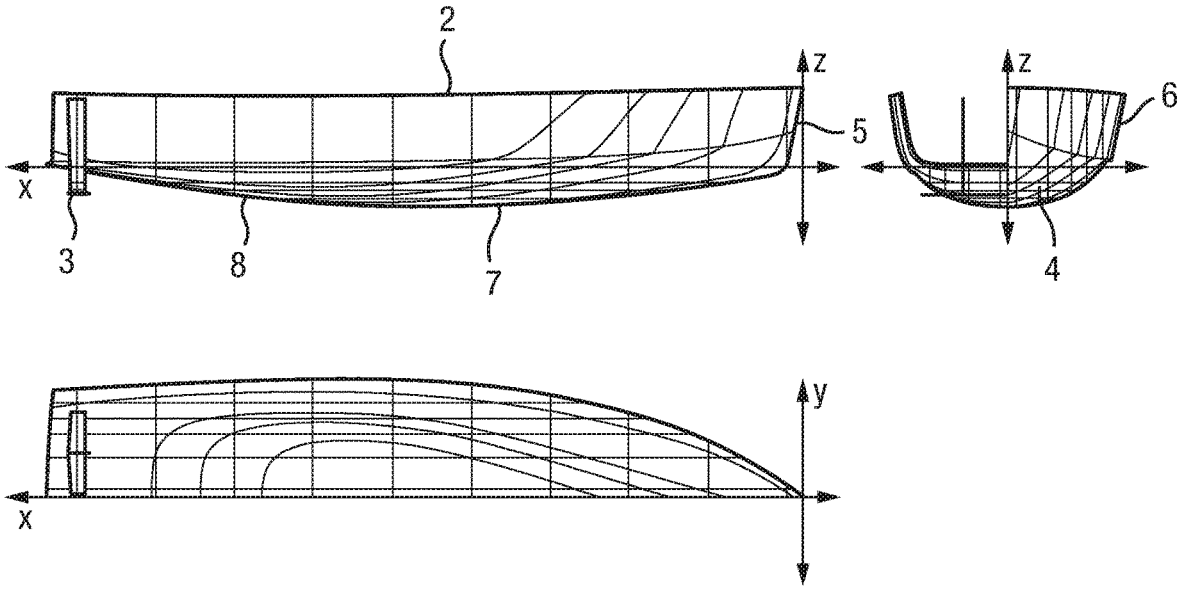
FIG. 10 is a lines plan of a powerboat according to an embodiment of the present invention.

As shown in FIGS. 10 and 11, the powerboat 1 of a first embodiment of the invention comprises a hull 2, a plurality of dynamically adjustable hydrofoils 3 positioned towards the rear of the hull 2, below the design waterline, and a control system 14 for the hydrofoils.

Figure 1:
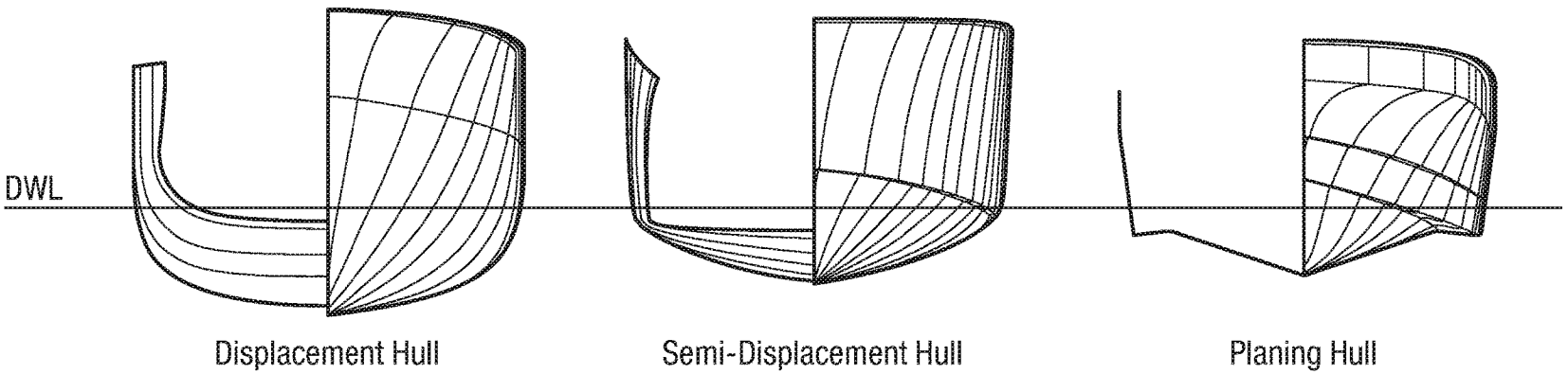
FIG. 1 shows typical displacement, semi-displacement, and planing hulls.
Figure 2:
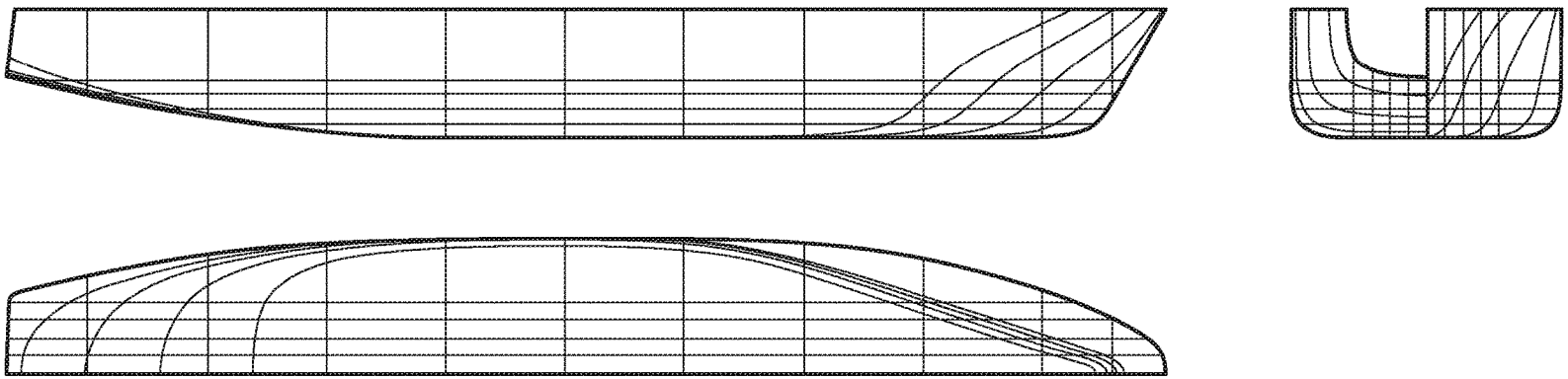
FIG. 2 shows a typical displacement hull form.
Figure 3A:
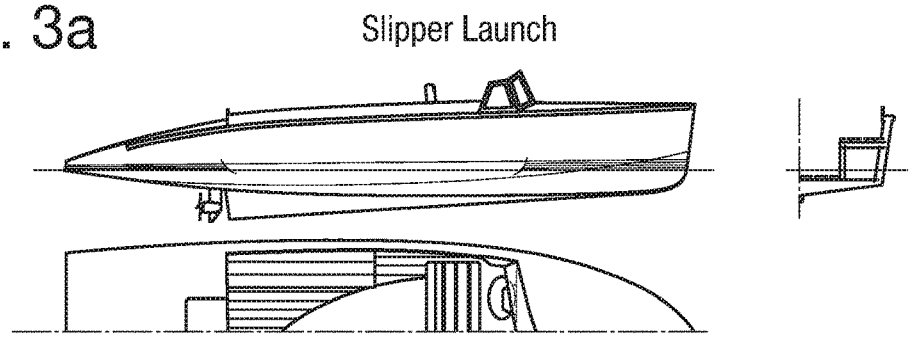
FIGS. 3*a* and 3*b* show other examples of typical displacement hull forms.
Figure 3B:
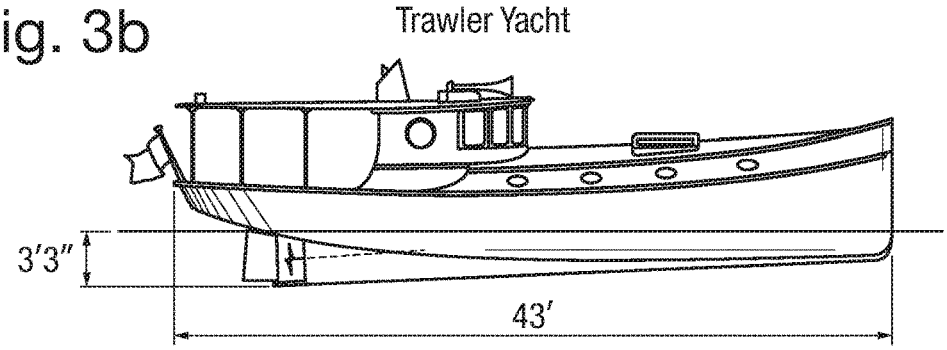
Figure 4:
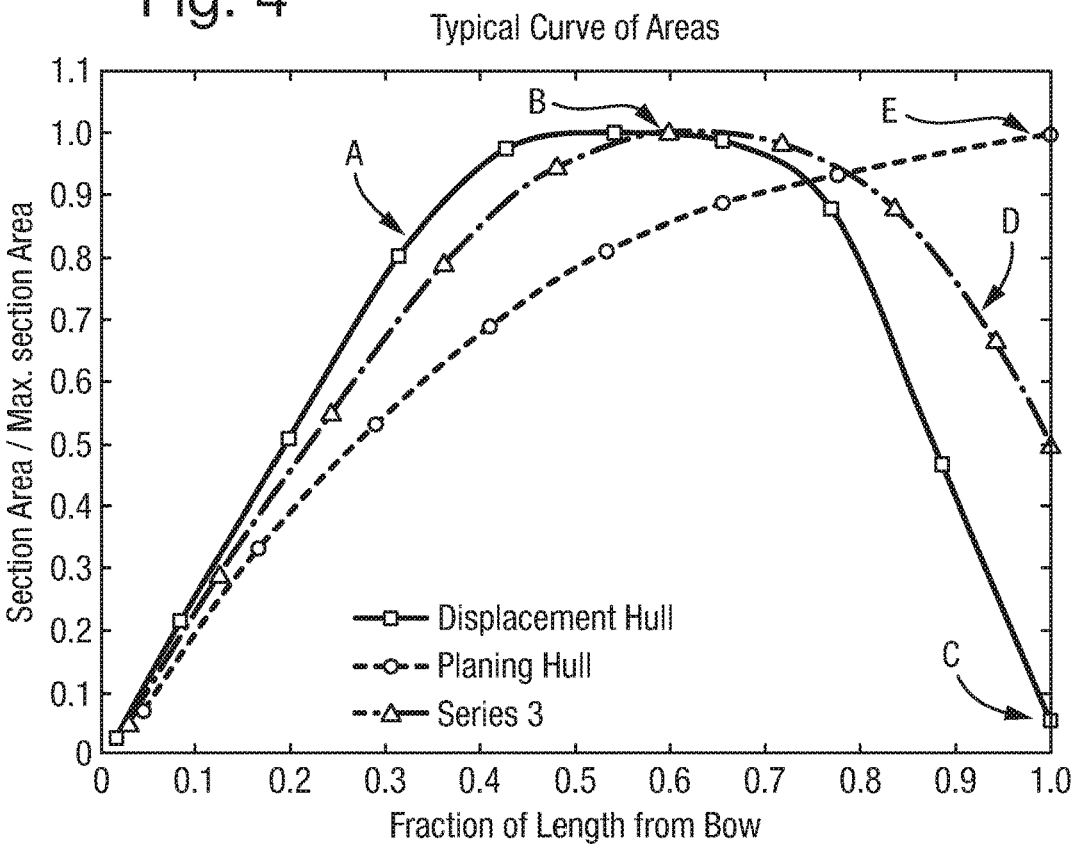
FIG. 4 shows typical curves of areas for displacement, semi-displacement, and planing hull forms.
Figure 5:
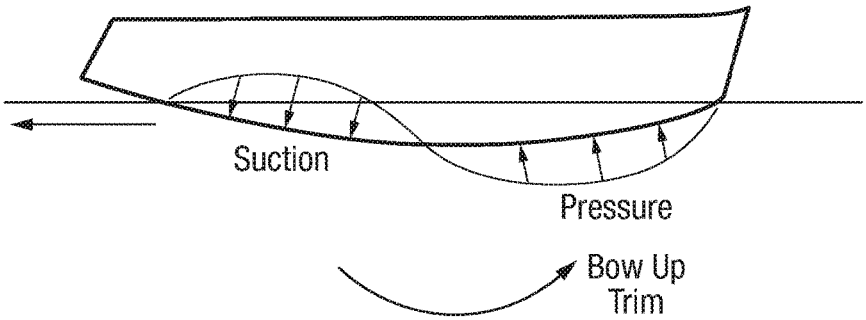
FIG. 5 shows the pressure distribution on a displacement hull form.
Figure 7:
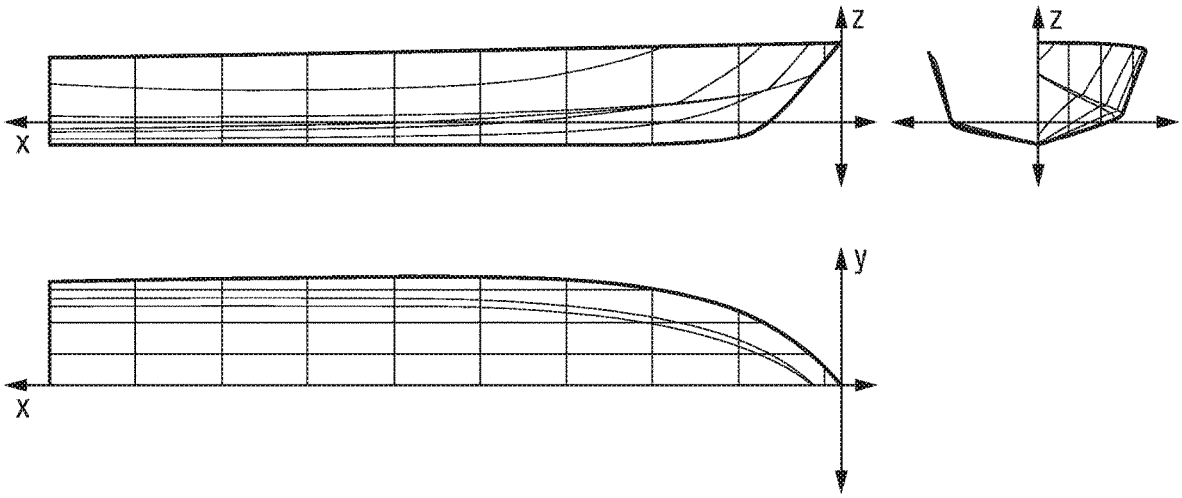
FIG. 7 shows an example of a typical planing hull form.
Figure 6:
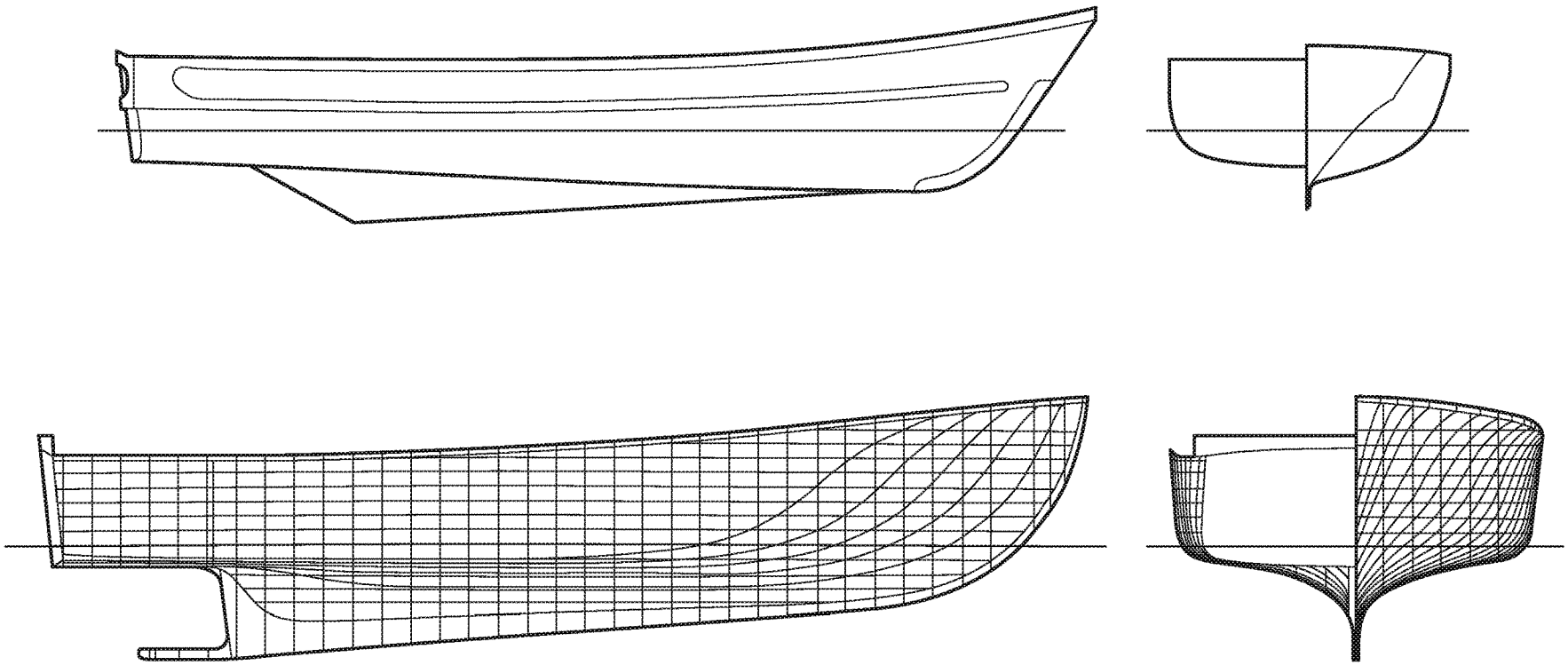
FIG. 6 shows examples of typical semi-displacement hull forms.
Figure 8:
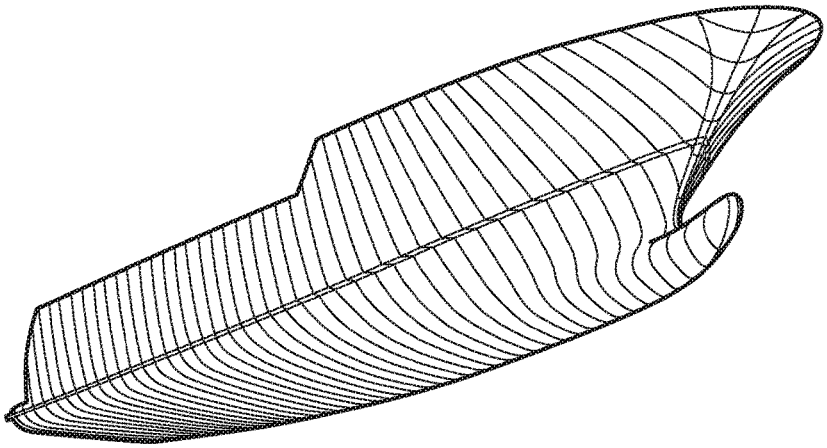
FIG. 8 shows a Fast Displacement Hull Form.
Figure 9:
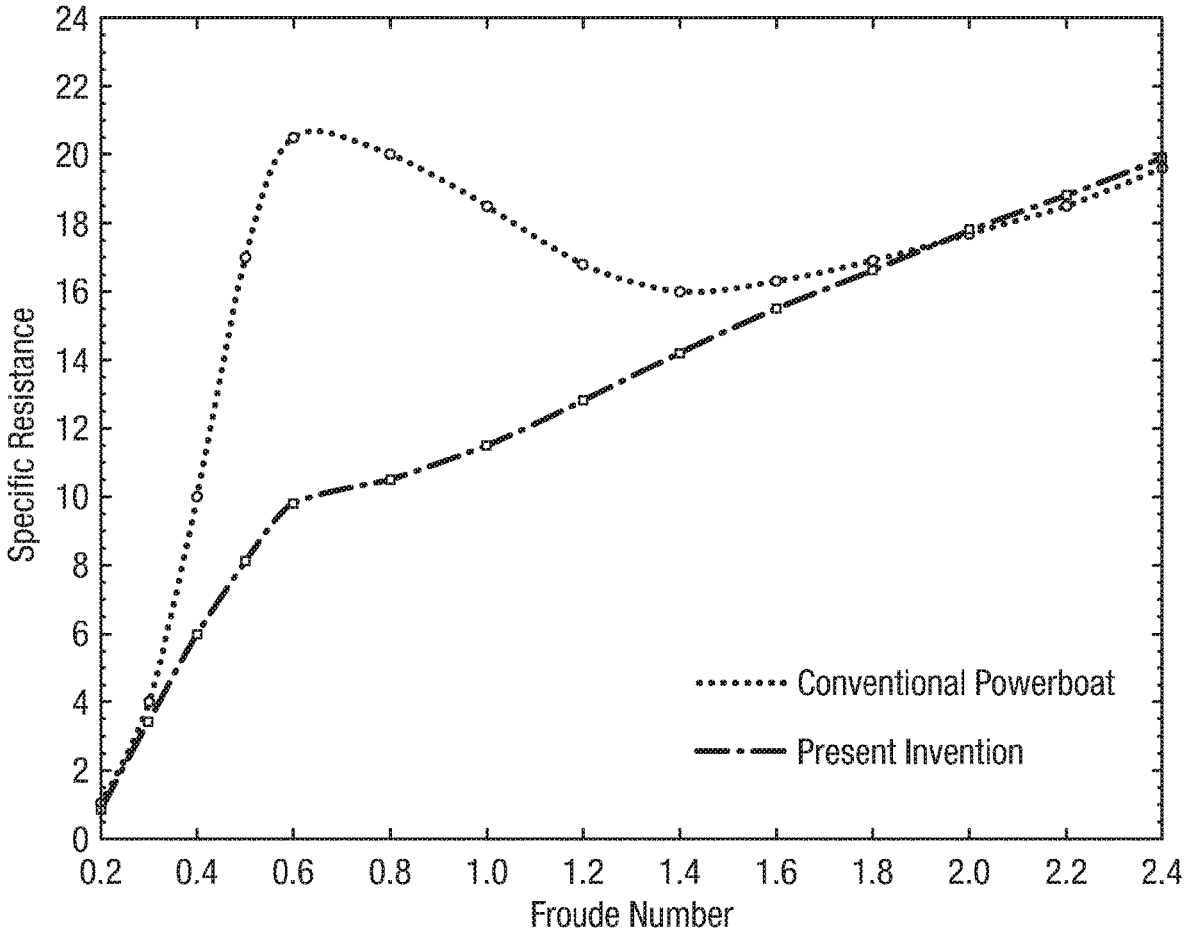
FIG. 9 compares resistance of the present invention with a conventional powerboat.

The hull 2 is shaped similarly to hulls typically used for operation in a displacement mode. The cross sectional area of the hull 2 reduces from the midship point to the transom (i.e. to the stern), such that the immersed area of the transom at rest is less than 40%, preferably less than 30%, more preferably less than 20%, and most preferably less than 10% of the maximum hull cross sectional area. In other words, the immersed volume of the hull 2 reduces from the midship section to the rear of the hull 2. This form of section distribution gives rise to a curve of areas (line A in FIG. 4) that corresponds to the norms for optimum resistance for a displacement hull. The LCB lies preferably between 45% and 65% of LWL aft of the forward perpendicular, more preferably between 50% and 60% and most preferably approximately 55%, and the prismatic coefficient ($C_p$) lies preferably in the range of 0.5 to 0.7, more preferably in the range of 0.55 to 0.65. The values of these coefficients of form may be adjusted depending on the length and displacement of the vessel.

The forward sections of the hull 4 are shaped to avoid pounding and slamming when operating in head waves. The forward sections are V-shaped, similarly to a conventional planing hull form, but the V-shaped sections are not present as far towards the rear of the craft as in a conventional planing hull form. In other words, the hull sections between 25% and 65% chord are more rounded than the V-shaped sections typically found at these locations in a conventional planing hull. The hull form can be different from a conventional planing boat, despite its planing performance, because the active foils mean that relative motion of the bow at planing speeds can be controlled with active foils. Thus, the impacts that the hull form will be called upon to mitigate will be less severe than for a conventional planing hull form due to the active attitude control. The plumb (near vertical) stem 5 is employed to maximize waterline length, again a feature that reduces resistance when operating in the displacement mode.

The hull form is not constrained by limits on Displacement/Length ratio, Length/Beam ratio, nor Beam/Draft ratio. The mid ship section shape 6 is configured for minimum resistance, coupled to the need to maintain a V or deep-U shape section to manage the potential wave impacts when travelling at high speed. The main feature of the centerline profile 7 is the plumb stem and the smoothly rising aft buttock lines that terminate at or just below the static waterline. The curvature of the aft buttock lines between midships and the stern 8 may be varied to adjust the volume of displacement and LCB to suit particular vessel configurations and fit out.

The hull of the present invention does not include a bulbous bow. In other words, the bow is shaped such that the whole portion of the bow below the design waterline is in line with, or aft of, the portion immediately above the design waterline.

Conventionally, as set out above, such a hull shape would be unsuitable for operation at a Froude number above 1 (i.e. in a planing mode). However, when this hull 2 is used in combination with the dynamically adjustable hydrofoils 3 (FIGS. 11*a* and 11*b*), the trim of the vessel can be controlled to prevent the stern sinking and thus to keep hull resistance down and ensure roll and pitch stability at high speeds.

Figure 11A:
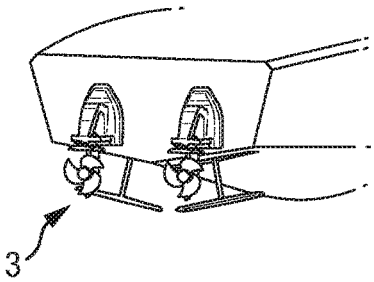
FIGS. 11*a* to 11*e* show configurations of hydrofoils in accordance with embodiments of the invention.
Figure 11B:
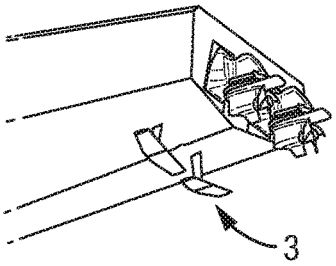
Figure 11C:
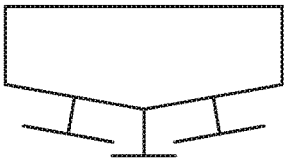
Figure 11D:
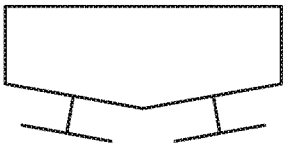
Figure 11E:
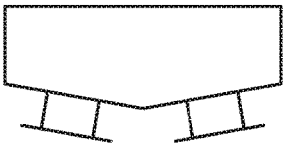
Figure 12A:
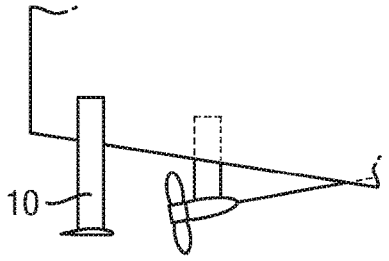
FIGS. 12*a*, 12*b*, and 12*c* show hydrofoils dispositions in conjunction with different propulsion systems in accordance with embodiments of the invention.
Figure 12B:
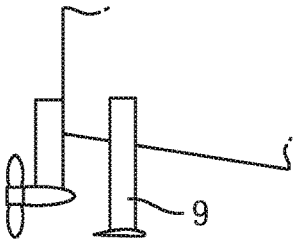
Figure 12C:
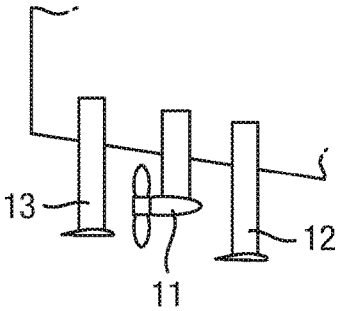

The number of hydrofoils in the array is not fixed, for example three hydrofoils might be used with a center foil, and two outboard (FIG. 11*c*). The number of vertical supports for each hydrofoil may vary dependent on structural design (FIGS. 11*d* & 11*e*). Where the vertical support is positioned downstream of the propeller then the rudder may be incorporated as a vertical support to the hydrofoil, removing the need for a separate rudder and reducing hydrodynamic resistance.

The powerboat 1 may be powered by an inboard engine and outdrive leg propeller (FIG. 12*b*) (i.e. stern drive propulsion) or by any other suitable source of propulsion such as shaft drive (FIG. 12*a*), pod drive (FIG. 12*c*), an outboard motor, or water jet.

The hydrofoils 3 may be positioned to best suit the vessel's drive train arrangement, e.g. ahead of sterndrive units, ahead or astern of pod propulsion systems, or astern of propellers on fixed shafts.

The planform and cross section (foil shape) of the hydrofoils can be of any conventional form. The shape and construction of the hydrofoils may be simple and robust or complex and sophisticated depending on the time and budget available. For example, the hydrofoils may be made from metal fabrications faired with solid material or clad in an FRP shroud. Typically the foil sections will be based on conventional sections, for example the NACA series. For operation at high Froude numbers the hydrofoil sections must be designed to optimize their behavior if cavitation is likely to occur.

Figure 13:
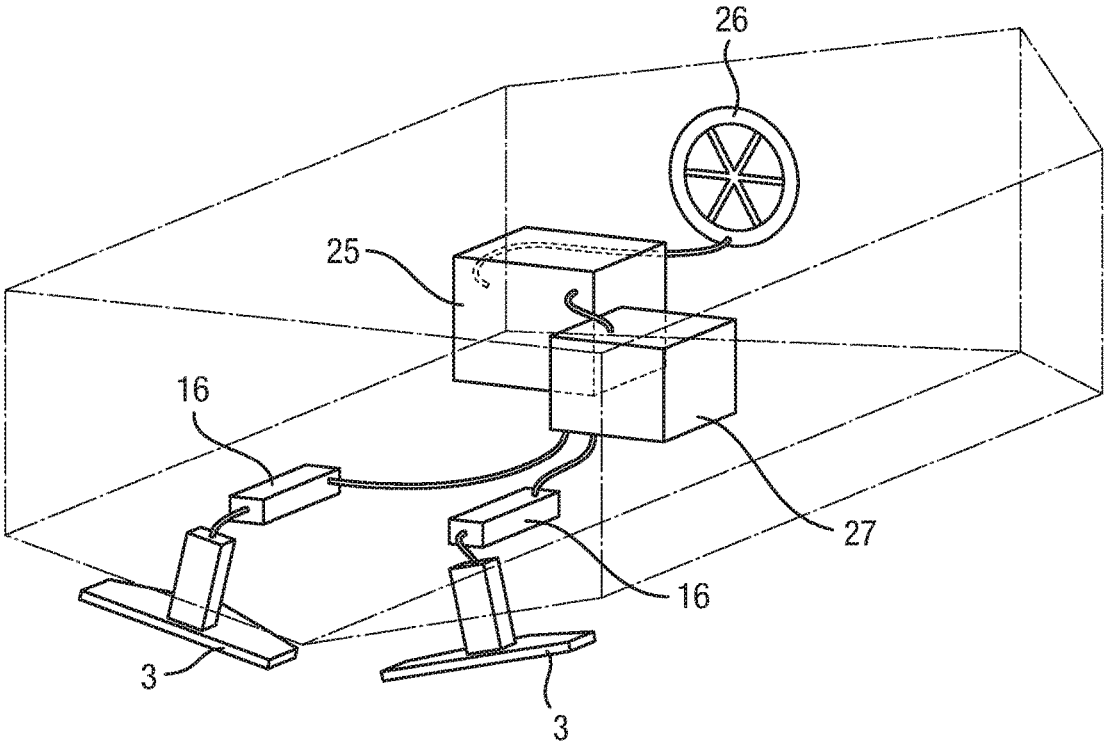
FIG. 13 shows a block diagram of the control system components of the powerboat of an embodiment of the present invention.

The hydrofoils 3 are dynamically adjustable by means of a control system 14, as shown in FIG. 13. The control system 14 is configured to move the hydrofoils 3 in the water as described in more detail below.

Figure 14A:
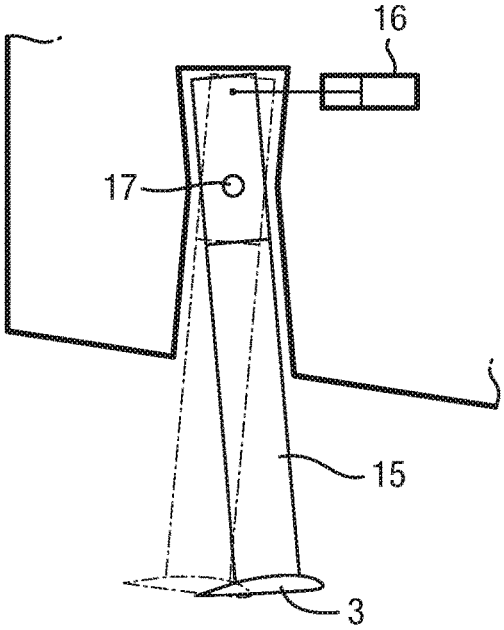
FIGS. 14*a* and 14*b* show a hydrofoil installation arrangement in accordance with an embodiment of the invention.
Figure 14B:
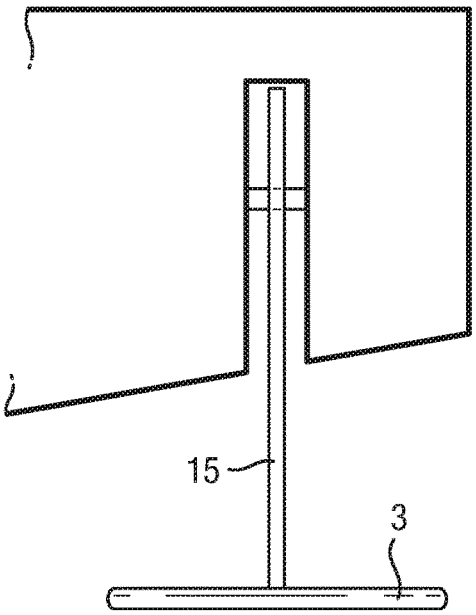

An important characteristic of the hydrofoil arrangement is that it comprises of a plurality of foils lying typically between 1 and 3 chord lengths below the local hull surface. As shown in FIG. 14, the foils are aligned in the transverse direction between horizontal and the local deadrise angle of the hull surface. The foils are attached to vertical supports 15 which penetrate the hull surface. The foils are connected to a system of actuators 16 that adjust the angle of the foils to the horizontal plane, and thereby produce a varying vertical force as directed by the control system. The foils can be adjusted independently of each other so that the array of foils may produce both a time varying vertical force and roll moment. By way of example, the angle of attack of the foils may be adjusted in the following ways, although this is a nonexhaustive list and a person skilled in the art will understand that further modifications are possible within the scope of the inventive concept described:

The foils may be fixed to vertical supports 15 that pass through the hull surface. The axis of rotation 17 is normal to the centerplane and the actuator 16 may be attached inside the hull, above or below the waterline, as shown in FIGS. 14*a* and 14*b*.

Figure 15A:
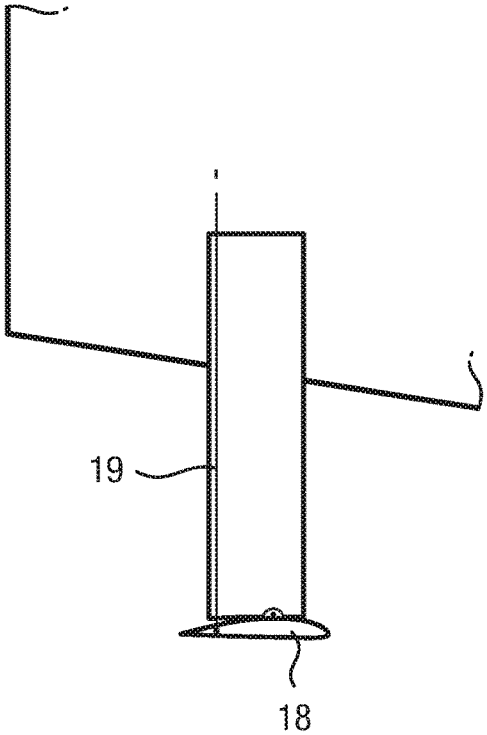
FIGS. 15*a* and 15*b* show alternative arrangements for hydrofoil configurations in accordance with embodiments of the invention.

The foil may be articulated at the lower end of the support strut 18, with the control mechanism 19 passing down the strut, as shown in FIG. 15*a*.

Figure 15B:
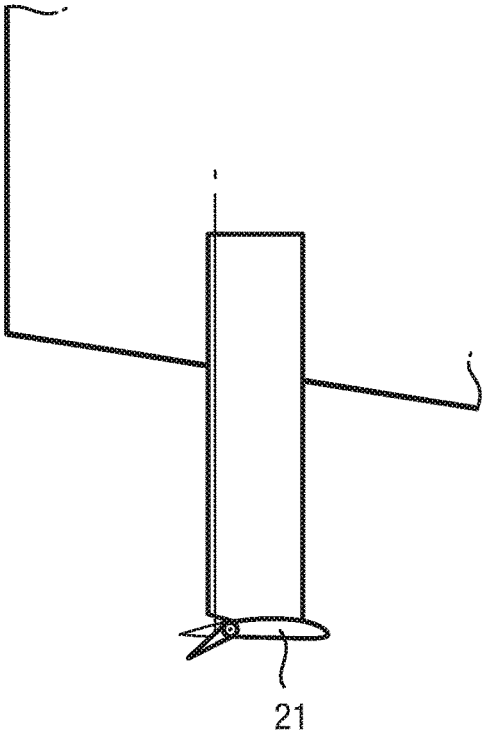

A flapped hydrofoil may be used, where the main part of the foil is rigidly attached to support strut 21 and the trailing edge flap is controlled by a mechanism that passes down the strut, as shown in FIG. 15*b*.

The hydrofoils may be retracted when not in use. This has several advantages. First, it allows the drag associated with the hydrofoils to be reduced and/or eliminated when they are not required. Second, it prevents the hydrofoils from being damaged and suffering from marine growth.

Figure 16A:
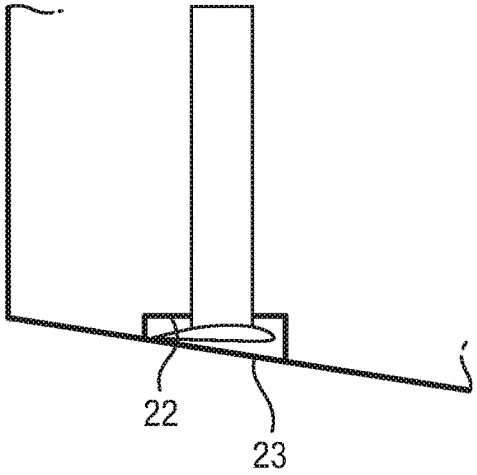
FIGS. 16*a* and 16*b* show various hydrofoil retraction arrangements in accordance with embodiments of the invention.
Figure 16B:
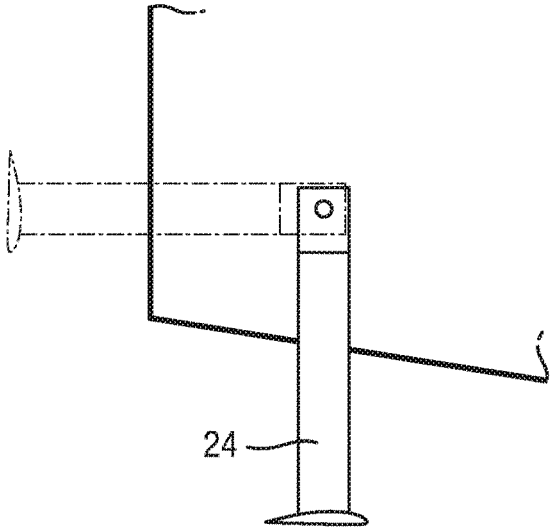

The arrangement chosen for a particular application will depend on the competing features of the installation, trading retractability against simplicity of operation. Typically the foils might be retracted into a recess in the hull bottom 22 as shown in FIG. 16*a*, which may have a closing plate 23, or rotated aft in a slot in the transom to lie above the water when retracted, as shown in FIG. 16*b*, or rotated laterally to be alongside the hull.

Figure 18:
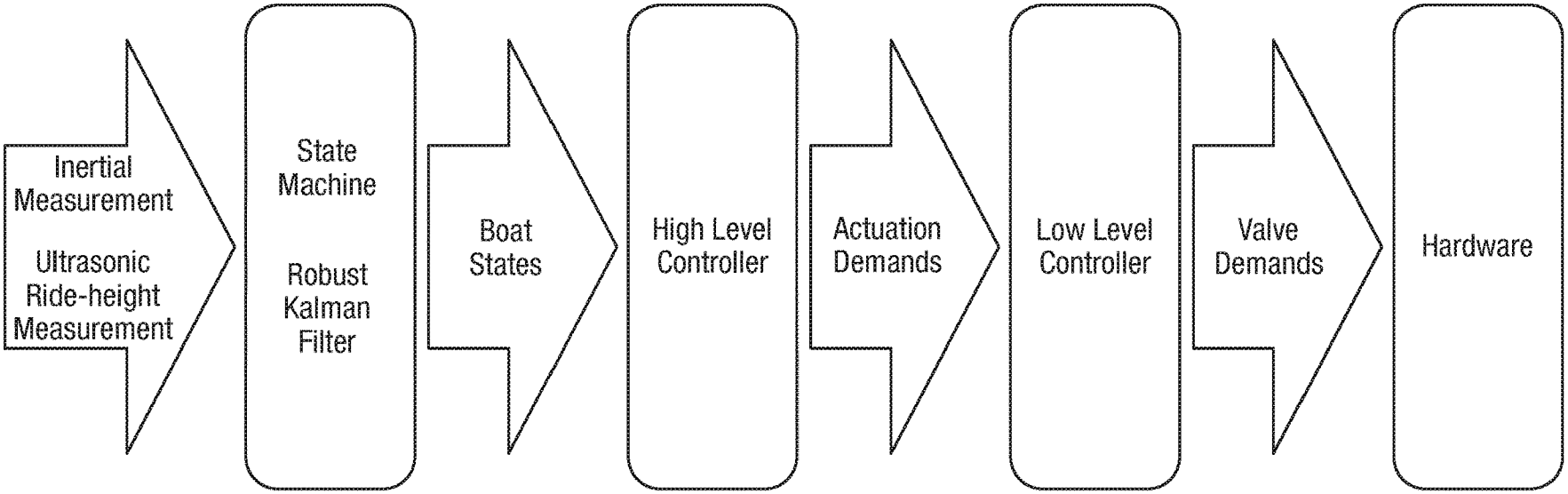
FIG. 18 shows a block diagram of a control system according to an embodiment of the present invention.

At a predetermined speed, the hydrofoils 3 are deployed by the control system 14. A block diagram of the control system 14 is shown in FIG. 18. The control system may comprise speed and attitude sensors, linked to PID controllers, with appropriate filters such as Kalman filters, and a power supply 27, to provide a control system which responds to the speed and attitude of the boat to deploy and then dynamically adjust the angle of attack of the foils to control the attitude of the boat as desired. As shown in FIG. 13, the control system may also be linked to the steering wheel 26 to provide "fly by wire" capability in which the foils operate in response also to the steering inputs to control the boat's attitude (e.g. trim and roll) to be within a safe envelope of operation.

As shown in FIG. 18, the control system 14 includes a state machine which is a model of the behavior of the boat. The state machine takes measurements of vessel speed and attitude (roll and pitch) and vessel motions (heave and sway) from the sensors as its inputs. Preferably these are filtered, e.g. by a Kalman filter, to provide stable control in the event that the input measurements are temporarily unavailable or incorrect. The boat state is output from the state machine to the high level controller, which calculates the movements required by the hydrofoils to carry out the necessary control. These are fed to the low level controller, which calculates the valve demands necessary to carry out the actuation demands ordered by the high level controller. The valve demands are then fed to the hardware that controls the movement of the hydrofoils. The hardware may be valves linked to the actuators as described above or may be any other suitable hardware for moving the hydrofoils. The output from the hardware is then fed back to the low level controller in a feedback loop, using a PID controller or other suitable feedback controller.

The control system 14 dynamically adjusts the angle of attack of the hydrofoils 3 in accordance with the boat speed to increase lift to the stern as the speed increases, which controls the trim of the boat 1. The speed at which the foils are deployed and the angle of attack of the hydrofoils for optimum performance will be predetermined for each speed and loading condition.

The trim of the boat 1 may be adjusted by adjusting the hydrofoils 3 in order to maintain the boat 1 at an optimum trim. This optimum trim will usually be associated with minimum resistance but may be adjusted to improve ride comfort or visibility if required. The predetermined initial deployment speed may be set by the preconfigured control system 14 or may be set manually by the helmsman.

Figure 17:
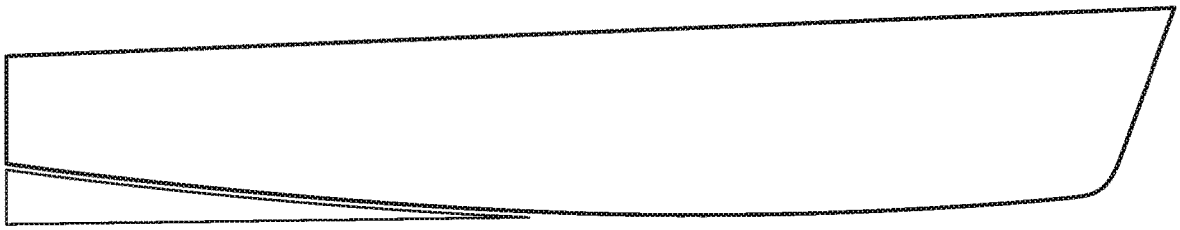
FIG. 17 illustrates the difference between a hull according to an embodiment of the present invention and a conventional planing hull.

When deployed at high speed, the hydrofoils 3 effectively "replace" the trim controlling effect of the "missing" part of the hull 2 towards the aft end of the boat 1 compared with a conventional high speed (planing) boat (FIG. 17). That is, the lift force that is provided by the rear part of the hull in a conventional high speed (planing) boat is instead provided by the hydrofoils 3. The hydrofoils also provide the stability conventionally derived from the hard chine and deep-V hull shape. The hydrofoils provide this damping effect even when in a fixed position, but because they may be individually controlled the angle of attack of the foils may be adjusted in antiphase to create a roll moment whilst maintaining the desired vertical force. With suitable software in the hydrofoil controller, this effect may be tuned to "simulate" the behavior of the hard chine hull shape, or to provide more effective active roll stabilization. At high speed, i.e. in planing mode, a significant fraction of the boat weight may be supported on the foils, the remainder being substantially supported by buoyancy and hydrodynamic lift on the hull 2. Thus the boat of the invention does not operate as a typical hydrofoiling craft in which the hydrofoils are designed to take the whole weight of the craft, but instead the foils 3 provide lift to support the aft portion of the boat and the fore portion is supported by the hull shape.

The proportion of the boat weight supported by the hydrofoils will depend on the speed of the boat. At low speed, the foils will support no substantial weight, and may even be fully retracted. As the speed rises, the foils will be adjusted to provide a vertical force that adjusts the boats running trim to an optimal value. Depending on the proportions (length/beam ratio, displacement/length ratio) of the vessel, at top speed the hydrofoils will support between 0% and 50%, preferably between 10% and 40%, more preferably 15%-25%, and most preferably 20% of the boat's weight. These values are the proportion of the boat's weight carried in flat water. However, these values will change transiently due to the fluctuating loads on the hydrofoils induced by the vessel's passage through the waves.

As described above, the adjustment of the hydrofoils 3 may take place automatically based on predetermined data. However, the control system 14 may also allow manual adjustment of trim prompted by a user input.

The control system 14 may also be configured to optimize characteristics other than resistance, such as comfort or safety. For example, the hydrofoils 3 may be automatically adjusted to control roll and pitch movements of the hull 2 at any speed using hull state data from an Inertial Navigation Unit (INU) 25. It may also be integrated with control of the steering of the boat 26 to maintain it within a safe operating envelope of roll and turn rate regardless of the operator inputs (FIG. 13).

The powerboat of the present invention has the advantage that it can be optimized to operate efficiently at a wide range of speeds. Typically powerboats of the present invention will be between 8-25 meters length. Typically such a vessel of 10 meters length may have a speed range of 8-45 knots, and a vessel of 25 meters length may have a speed range of 12-70 knots. Powered watercraft that are designed to operate at the upper end of this range, such as high performance powerboats, typically have the disadvantage that in order to be safe at their maximum speed, they have hulls with very high resistance at low speeds. Likewise, watercraft that are designed to operate at the lower end of this speed range are not suitable for use at high speeds. Thus, the present invention provides a watercraft which can operate efficiently across the whole speed range or can be optimized for comfort or stability across the whole speed range.

A further advantage of the arrangement of the present invention is that the dynamically adjustable hydrofoils 3 may be used to control the roll and pitch motions of the boat, as well as to control trim. The control system may have user selected modes that modify the handling and feel of how the boat dynamically responds to the sea state. For example a sports mode or a comfort mode may be selected which vary the active roll and trim response of the boat to the control system inputs.

This invention is particularly useful for power craft which are battery/thermal engine hybrids. Such a hybrid propulsion system uses batteries and electric motor for low speed operation and a thermal engine for high speed operation. To ensure maximum battery duration and minimize battery weight the hull resistance at lower speeds must be as low as possible.

What is claimed is:

1. A powerboat comprising:

a hull;

a plurality of dynamically adjustable hydrofoils positioned below the water line towards the rear of the hull; and a control system;

wherein the cross-sectional area of the hull below the waterline decreases towards the rear of the hull; and the control system is configured to adjust the hydrofoils in operation of the powerboat to control the running trim of the powerboat; and wherein the hydrofoils are configured to support between 0% and 50% of the weight of the powerboat at its top speed.

2. The powerboat according to claim 1, wherein the hydrofoils are at least one of retractable and movable to a position above the waterline.

3. The powerboat according to claim 2, wherein the hydrofoils are retractable into a recess in the hull.

4. The powerboat according to claim 1, wherein the hydrofoils further comprise a trailing edge flap.

5. The powerboat according to claim 1, further comprising a fixed hydrofoil.

6. The powerboat according to claim 5, wherein the centerline of the fixed hydrofoil is substantially aligned with the centerline of the powerboat.

7. The powerboat according to claim 1 wherein the hydrofoils are positioned aft of the powerboat drive.

8. The powerboat according to claim 1 wherein the hydrofoils are positioned forwards of the powerboat drive.

9. The powerboat according to claim 1 wherein the hydrofoils are positioned both forwards of and aft of the powerboat drive.

10. The powerboat according to claim 1 wherein the hydrofoils are configured to support between 10% and 40% of the weight of the powerboat at top speed.

11. The powerboat according to claim 1 wherein the hydrofoils are configured to support between 15% and 25% of the weight of the powerboat at top speed.

12. The powerboat according to claim 1 wherein the control system is configured to automatically adjust the hydrofoils to at least one of:

control the running trim of the powerboat;

control at least one of roll and pitch motions of the boat; and reduce and minimize hydrodynamic drag on the hull.

13. The powerboat according to claim 1 wherein the immersed area of the transom at rest is less than 40% of the maximum hull cross-sectional area.

14. The powerboat according to claim 1 wherein the controller comprises a speed sensor and/or attitude sensor.

15. The powerboat according to claim 1 wherein the hydrofoils are positioned in the rear 30% of the length of the hull.

16. The powerboat according to claim 1 wherein each hydrofoil is connected to the hull by one or more struts.

17. The powerboat according to claim 1 wherein a strut connecting the hydrofoil to the hull is used as a rudder.

18. The powerboat according to claim 1 wherein all portions of the bow which are below the design waterline are in line with, or aft of, all portions of the bow which are above the design waterline.

19. The powerboat according to claim 1 wherein the stem of the powerboat is substantially vertical.

20. The powerboat according to claim 1 wherein the longitudinal position of maximum width of the hull is at 70% or less of the distance from bow to stern.

21. The powerboat according to claim 1 wherein a transition from V-shaped hull underwater cross section at the bow to rounded underwater hull cross section occurs by 50% of the distance from bow to stern.

* * * * *